United States Patent [19]

Dunning et al.

[11] 3,949,035

[45] Apr. 6, 1976

[54] METHOD OF FORMING A LIGHTWEIGHT AIRLAID WEB OF WOOD FIBERS

[75] Inventors: Charles E. Dunning, Neenah; Stanley R. Kellenberger, Appleton, both of Wis.

[73] Assignee: Kimberly-Clark Corporation, Neenah, Wis.

[22] Filed: Sept. 10, 1973

[21] Appl. No.: 396,112

Related U.S. Application Data

[63] Continuation of Ser. No. 145,546, May 20, 1971, and a continuation of Ser. No. 783,877, Dec. 16, 1968, abandoned, and a continuation of Ser. No. 882,257, Dec. 4, 1969, Pat. No. 3,692,622, which is a continuation of Ser. No. 783,877, Dec. 16, 1968, abandoned, and a continuation of Ser. No. 145,452, May 20, 1971, abandoned, and a continuation of Ser. No. 384,705, Aug. 1, 1973, Pat. No. 3,825,381.

[52] U.S. Cl. ..... 264/90; 264/91; 264/101; 264/119; 264/121; 264/128

[51] Int. Cl.[2] ..... B29C 17/04

[58] Field of Search ..... 264/128, 121, 119, 90, 264/91, 101

[56] References Cited

UNITED STATES PATENTS

| | | | |
|---|---|---|---|
| 2,803,577 | 8/1957 | Colt et al. | 264/119 |
| 2,986,780 | 6/1961 | Bletzinger | 264/128 |
| 3,043,733 | 7/1962 | Harmon et al. | 156/209 |
| 3,150,416 | 9/1964 | Such | 264/128 |

*Primary Examiner*—Robert F. White
*Assistant Examiner*—J. R. Hall
*Attorney, Agent, or Firm*—Wolfe, Hubbard, Leydig, Voit & Osann, Ltd.

[57] ABSTRACT

A method of forming an airlaid web at high speeds, the web being suitable for tissue and toweling applications, includes air forming a flimsy continuum on to a foraminous surface, wetting the continuum in a prescribed fashion, employing the wetted surface of the continuum to achieve stripping from the foraminous surface and transfer to a transfer surface and bonding the continuum to yield a coherent web while the wetted continuum remains adhered to the transfer surface.

21 Claims, 13 Drawing Figures

38
48
54
3
56
52
60
88
62
74
58
73
84
76
86
82
64
50
78
80
66
68
92
3

70
72
74
64
92

Fig. 5.
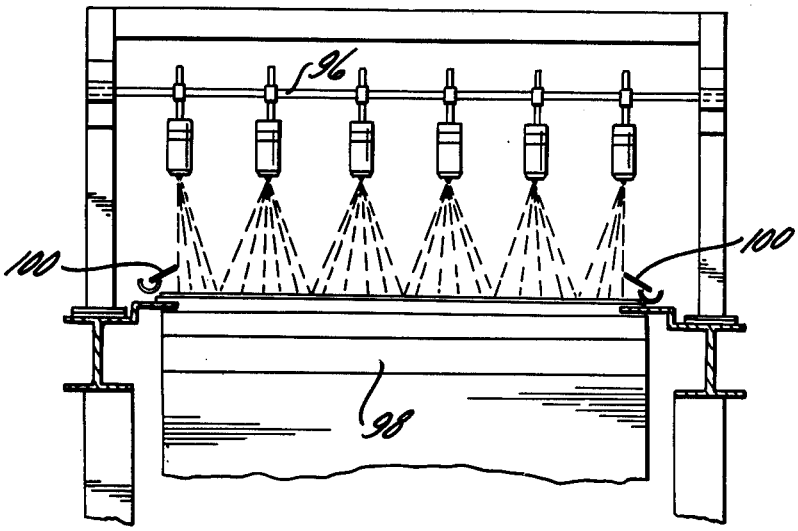
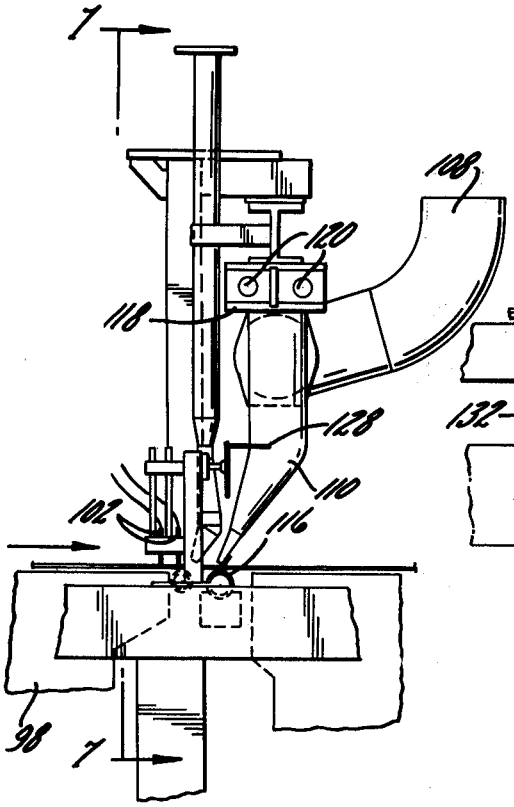
Fig. 6.
Fig. 8.
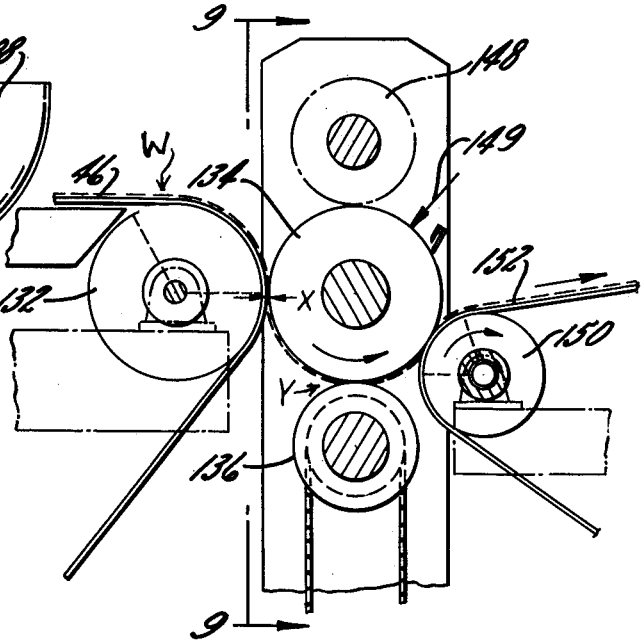

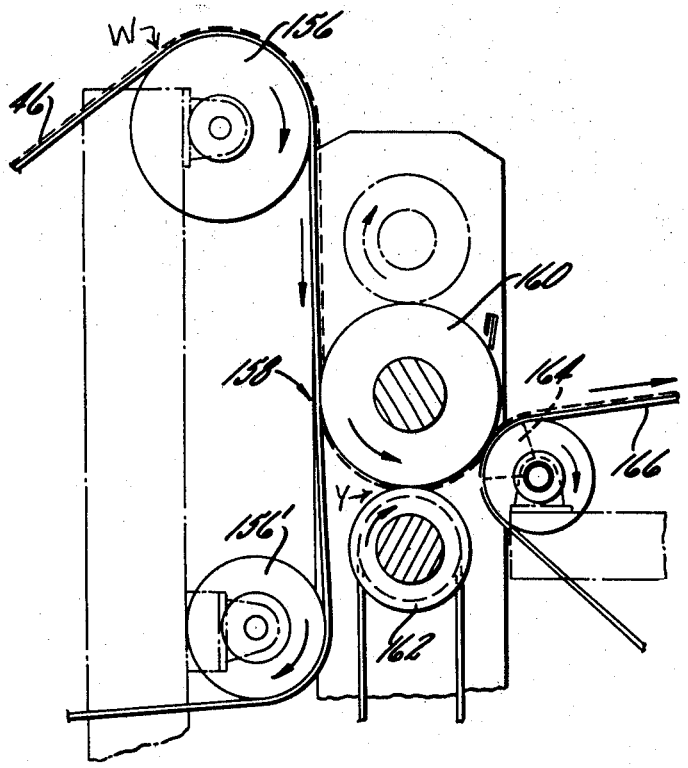
Fig. 11.
Fig. 12.
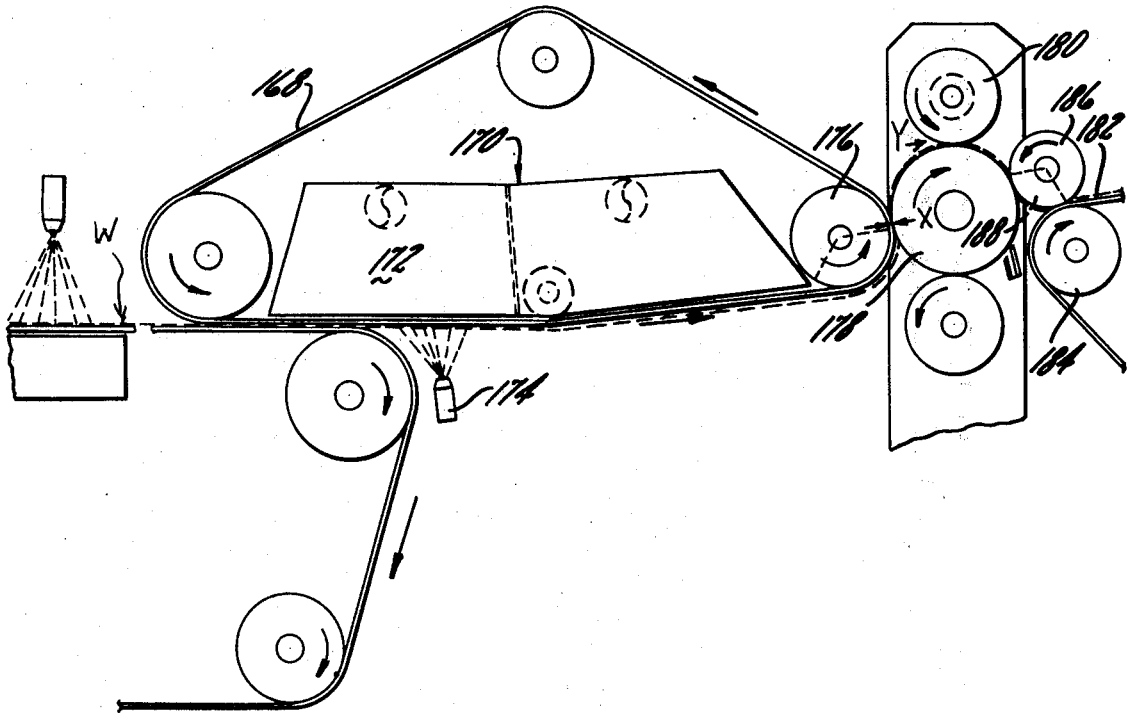

METHOD OF FORMING A LIGHTWEIGHT AIRLAID WEB OF WOOD FIBERS

RELATED APPLICATIONS

This is a continuation of Charles E. Dunning and Stanley R. Kellenberger, Ser. No. 145,546, filed May 20, 1971 for: "A METHOD OF FORMING A LIGHTWEIGHT AIRLAID WEB OF WOOD FIBERS".

Charles E. Dunning Ser. No. 783,877, filed Dec. 16, 1968, for "Air-Formed Web and Method for Making Such Webs", now abandoned;

Charles E. Dunning, Ser. No. 882,257, now U.S. Pat. No. 3,692,622 filed Dec. 4, 1969, for: "Air-Formed Web and Method for Making Such Webs", a continuation-in-part of Ser. No. 783,877 now abandoned.

Charles E. Dunning and Stanley R. Kellenberger application entitled "Apparatus for Forming an Airlaid Web", Ser. No. 145,452 filed May 20, 1971 now abandoned and replaced by Dunning and Kellenberger continuing application Ser. No. 384,705 filed Aug. 1, 1973, now U.S. Pat. No 3,825,381, issued July 23, 1974.

BACKGROUND OF THE INVENTION

This invention relates to a method for manfacturing cellulosic sheet materials and, more particularly, to a high speed method for forming webs from airlaid wood fibers, the webs being characterized by desirable combination of strength, absorbency, and tactile properties and suitable for uses such as, for example, sanitary wipes and toweling.

Conventionally, materials suitable for use as disposable tissue and towel products have been formed on paper-making equipment by water laying a wood pulp fibrous sheet. Conceptually, this equipment is designed so that the configuration of the resulting sheet approaches a two-dimensional structure. This allows continuous operation at high speeds, and such sheets may be formed at speeds of 3,000 to 4,000 feet per minute. Indeed, recent developments have allowed sustained production at speeds of up to 5,000 feet per minute.

Following formation of the sheet, the water is removed either by drying or by a combination of pressing and drying. As water is removed during formation, surface tension forces of very great magnitude develop which press the fibers into contact, resulting in overall hydrogen bonding at substantially all the intersections of the fibers; and a thin, essentially two-dimensional sheet is formed. It is the hydrogen bonds between fibers which provide the sheet strength, and such bonds are produced even in the absence of extensive additional pressing. Due to this overall bonding phenomenon, cellulosic sheets prepared by water-laid methods inherently possess very unfavorable tactile properties (e.g. harshness, stiffness, low bulk, and poor overall softness) and absorbency for use as sanitary wipes and toweling.

To improve these unfavorable properties, water-laid sheets are typically creped from the dryer roll; i.e. — the paper is scraped from a dryer roll with a doctor blade. Creping reforms the flat sheet into a corrugated-like structure thereby increasing its bulk and simultaneously breaking a significant portion of the fiber bonds, thus artificially improving the tactile and absorbency properties of the material. But creping raises several problems. It is only effective on low, e.g. — less than about 15 pounds per 2880 ft.$^2$, basis weight webs, and higher basis weight webs remain quite stiff even after creping and are generally unsatisfactory for uses such as quality facial tissues. Because of this, it is conventional practice to employ at least two plies of creped low basis weight paper sheets for such uses. Only by doing this can a sufficiently bulky product with acceptable softness be prepared. Still further, the detrimental effects of the initial overall bonding in a water-laid paper sheet are not completely overcome.

Sanford et al. (U.S. Pat. No. 3,301,246) proposed to improve the tactile properties of water-laid sheets by thermally pre-drying a sheet to a fiber consistency substantially in excess of that normally applied to the dryer surface of a paper machine and then imprinting the partially dryed sheet with a knuckle pattern of an imprinting fabric. The sheet is thereafter dryed without disturbing the imprinted knuckle-pattern bonds. While this method may somewhat improve the softness, bulk and absorbency of the resulting sheet, the spaces between the knuckle bonds are still appreciably compacted by the surface tension forces developed during water removal and considerable fiber bonding occurs. Creping is still essential in order to realize the maximum advantage of the proposed process; and, for many uses, two plies are still necessary.

As will be apparent from the foregoing discussion, conventional paper-making methods utilizing water are geared towards the high speed formation of essentially two-dimensional sheets which inherently possess the inefficient attribute of initial "overbonding," which then necessitates a creping step to partially "debond" the sheet to enhance the tactile properties.

Air forming of wood pulp fibrous webs has been carried out for many years; however, the resulting webs have been used for applications where either little strength is required, such as for absorbent products, i.e. — pads, or applications where a certain minimum strength is required but the tactile and absorbency properties are unimportant; i.e. — various specialty papers. U.S. Pat. Nos. 2,447,161 to Coghill and 2,810,940 to Mills and British Patent No. 1,088,991 illustrate air-forming techniques for such applications.

Indeed, heretofore, it has not been believed that air forming techniques could be advantageously used to prepare cellulosic sheet material that would be sufficiently thin and yet have adequate strength, together with softness and absorbency to serve in applications such as sanitary wipes and toweling.

U.S. Pat. No. 3,692,622 assigned to the same asignee as the present application discloses an aesthetically pleasing web having a combination of strength, absorbency and tactile properties suitable for such applications. This novel product is made by air forming wood pulp fibers to provide a three-dimensional continuum of such fibers and thereafter pattern bonding the fibers by applying a limited amount of moisture and high pressure in a spaced pattern of small areas in the web.

While the properties of such webs make them highly desirable for applications such as sanitary wipes and toweling, widespread usage is contingent upon the ability to make the webs in an economic fashion. This necessitates forming the product at high speeds, desirably in excess of 1,000 feet per minute. Operation at such speeds, however, creates a considerable variety of problems. A particularly difficult problem arises because the airlaid continuum which is formed has little integrity and yet must be subjected to a bonding step that requires removal of the flimsy continuum from the wire on which it was formed. Bonding, at such speeds, to provide the desired strength levels and coherency of the product also creates difficulties.

It is accordingly an object of the present invention to provide a method for forming airlaid cellulosic webs at high speeds.

Another object of the present invention lies in the provision of a high speed method in which the airlaid continuum may be readily transferred from the surface on which it is formed into and out of a bonding station. A related and more specific object is to provide a method of the herein-described type wherein a transfer surface receives the continuum which adheres thereto until completion of the bonding step.

Other objects and advantages of the present invention will be apparent as the following description proceeds, taken in conjunction with the accompanying drawings in which.

Figures 1, 4A, 4B:
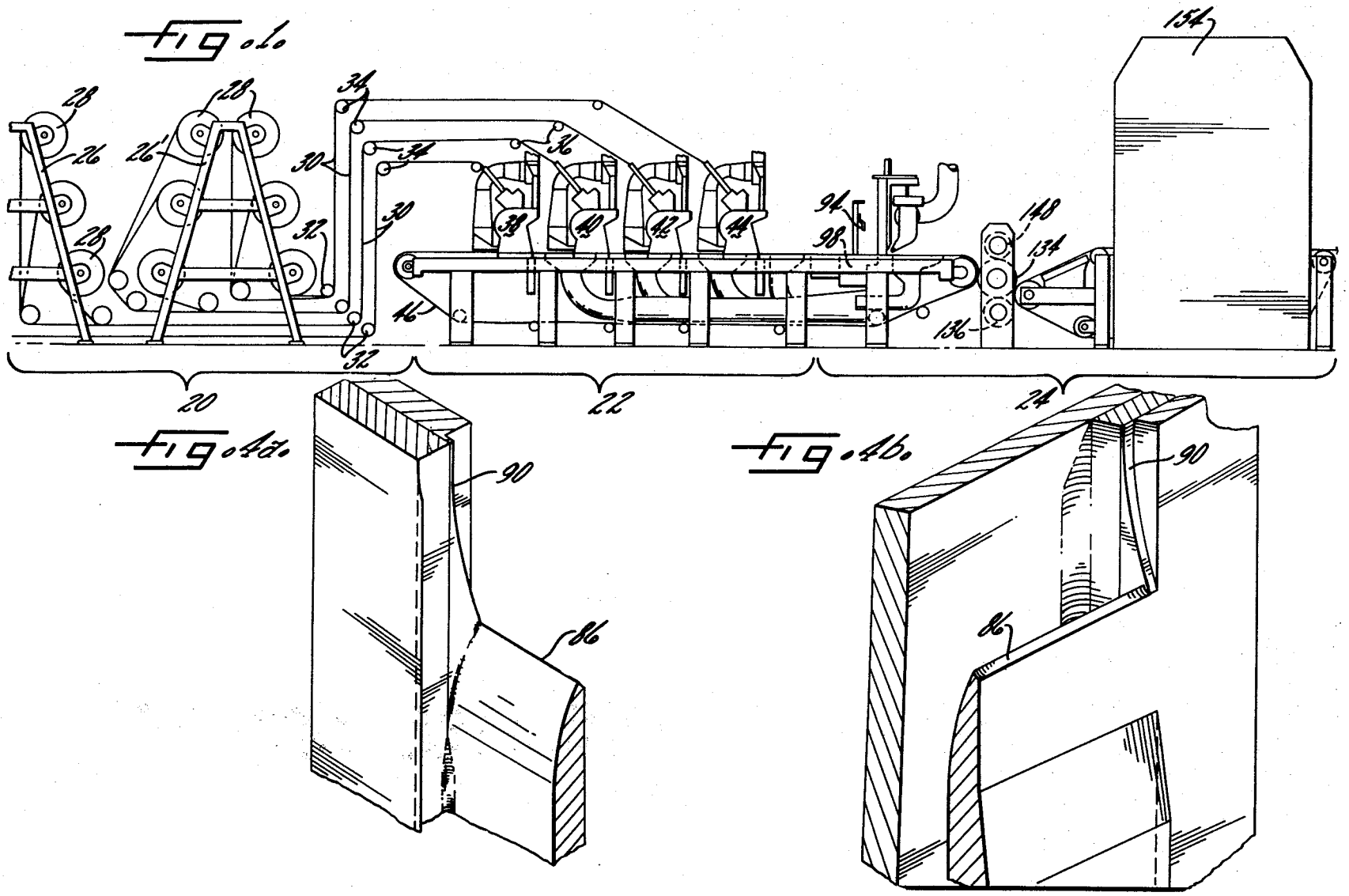
FIG. 1 is a side view illustrating an exemplary apparatus for carrying out the method of the present invention.
Figures 7, 9, 10:
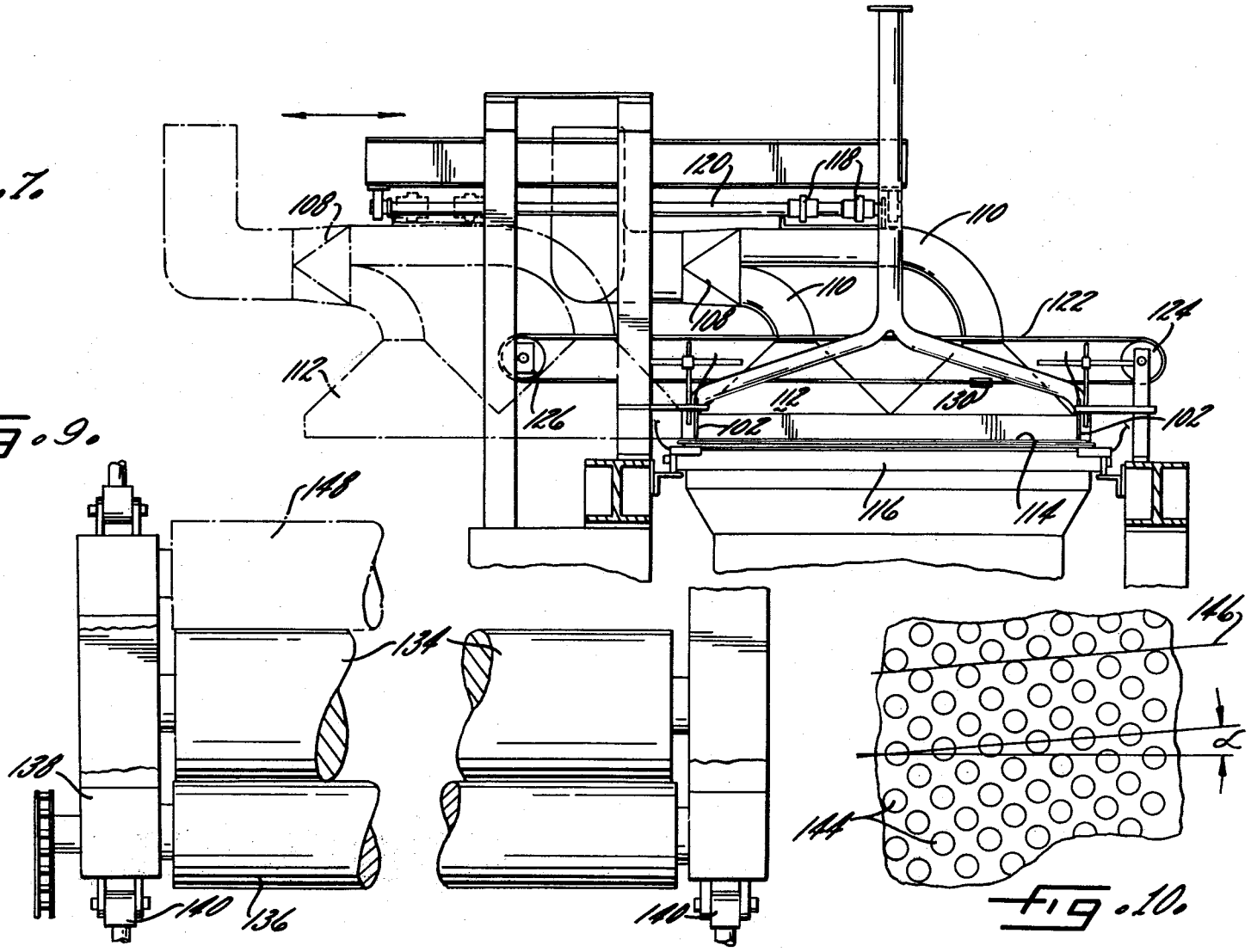

FIGS. 4*a* and 4*b* are perspective views, enlarged and partially in section and illustrating the internal construction of a portion of the apparatus for picking and forming the continuum;

FIG. 5 is a schematic end elevation view and showing the method of applying water to the continuum;

FIG. 6 is a side elevation view and illustrating the apparatus for separating the trim from the wetted continuum and for removing the continuum from the forming wire prior to stabilized operation during startup;

FIG. 7 is another view taken generally along lines 7—7 of FIG. 6 and further showing the trim pickup and the continuum pickup;

FIG. 8 is a side elevation view and schematically illustrating one embodiment for carrying out the transfer of the continuum to and through the bonding step;

FIG. 9 is a view taken generally along line 9—9 of FIG. 8 and further illustrating the transfer and bonding steps;

FIG. 10 is an enlarged fragmentary view and showing one embodiment of the configuration and pattern of raised surfaces of a roller that may be used for the bonding step;

FIG. 11 is a schematic side view and illustrating another embodiment that may be used for carrying out the transfer and bonding steps, and FIG. 12 is a schematic side view and illustrating still another embodiment which may be employed to carry out the transfer and bonding functions.

While the invention is susceptible of various modifications and alternative forms, specific embodiments thereof have been shown by way of example in the drawings and will hereafter be described in detail. It should be understood, however, that it is not intended to limit the invention to the particular form disclosed but, on the contrary, the intention is to cover all modifications, equivalents and alternatives falling within the spirit and scope of the invention as expressed in the appended claims.

Briefly, the method of the present invention comprises forming an airlaid continuum on a foraminous surface and then wetting the flimsy continuum with water in such a fashion that sufficient water is provided for carrying out the bonding, coherency is imparted to the continuum and the water is disposed so that transfer can be effected in accordance with the present invention. In keeping with this invention, the thus-wetted web is then transferred into and out of a bonding step to transform the flimsy continuum into a coherent web while minimizing the adverse effects on the desirable tactile properties of the continuum. The present method allows the formation at speeds in excess of 1,000 feet per minute of webs, which have a desirable combination of absorbency and aesthetics together with satisfactory strength levels.

Turning now to the figures, FIG. 1 illustrates an apparatus for carrying out the method of the present invention. The apparatus comprises a pulp sheet feeding section 20, a fiber lay-down section 22 and a bonding section 24. The pulp sheet feeding section feeds one or more pulp sheets into the fiber lay-down section in which the pulp sheets are separated into their component fibers and the fibers carried in an air stream to a moving screen form a uniform continuum of unbonded fibers. The moving screen transports the fiber continuum which is then transferred to the bonding step wherein a combination of pressure, water and heat is utilized to produce a plurality of spaced bond areas transforming the fiber continuum into a coherent structure, which after drying in a downstream portion of the bonding section, results in the soft absorbent web described in previously identified copending application Ser. No. 882,257 now U.S. Pat. No. 3,692,622.

Considering more specifically the pulp feed section, a source of fibers in combined form is provided and is forwarded to the fiber lay-down section. As illustrated, the pulp feed section may suitably comprise a pair of similar A-frame structures 26, 26′, each of which carries or supports a number of pulp rolls 28. The pulp rolls supply plies of pulp that are selectively combined to form multi-ply sheets 30 for feeding into the fiber lay-down section. As shown, each of the A-frame structures 26, 26′ carry six pulp rolls 28, which are combined to form four multi-ply pulp sheets 30. While the particular embodiment described includes multi-ply pulp sheets having a three-ply configuration, it should be appreciated that a greater or lesser number of plies may be used if desired, provided that the thickness of the pulp sheets are within acceptable limits for use in the fiber lay-down section.

The type of fibers employed for the pulp sheets will be dictated by the requirements of the particular application involved. Pulps having relatively thin walled, long fibers (cedars) to coarse pulps with thick fiber walls (southern pine) may be used for various purposes. Cedar pulps yield a soft and fluffy texture, while southern pine pulps give a slightly wooly texture and more body. The employment of fibers with thin walls is preferred for applications wherein it is desired to maximize the flexibility of the product. Typically, the fibers used herein will have a length of less than ½ inch and, more particularly, have an average length distribution of about 1 to 5 mm. Sheets of pulp prepared by the Kraft process have been found to be particularly desirable; however, so long as the fibers separated from the sheet can be susequently bonded as described herein, the manner of the preparation of the pulp is not particularly critical.

Desirably, for high speed operations, a pulp sheet should be selected which may be readily separated into its component fibers at high capacities while minimizing fiber breakage and/or degradation, as by burning. Sheets of unbeaten fibers are generally desirable but the strength of the sheet should be selected so as to facilitate the picking or divellicating operation. To further facilitate picking, a debonding agent or a mechanical debonding operation can be employed; however, quite obviously, the amount of such a chemical debonder should only be used in an amount which does not excessively detract from the subsequent bonding that occurs at selected sites in the present process.

Typically, the pulp sheet density may be about 0.5 grams per cubic centimeter or more with basis weights in the range of 200 to 300 pounds per 2880 ft.$^2$ or even more. As long as the strength of the pulp sheet is coordinated to provide ease in the picking operation, higher densities are desirable since this will result in greater picking capacities.

The specific method and means employed to separate the pulp sheets into their individual fibers and to transport the separated fibers to a collecting surface do not form a part of the present invention; but the picking apparatus set forth in Appel and Sanford, U.S. Pat. No. 3,606,175 and the forming means illustrated in Appel, Ser. No. 882,265, filed Dec. 4, 1969, now abandoned, have been found to be particularly advantageous and well suited for use in the high speed method of the present invention. Thus, as shown in FIG. 1, the pulp sheets are then passed around rolls 32, 34 and 36 to place them in the proper elevation for feeding into the fiber lay-down section and for achieving coincidence or alignment of the plies.

While the picking could be carried out at a single location, it is advantageous to use several locations in series so that the basis weight of the continuum is thereby sequentially built up. In this fashion, the speed of the unit may be increased without sacrificing uniformity of the continuum or the quality of the picking. As shown in FIG. 1, there are four pickers or picking assemblies shown, an upstream picker 38 and downstream pickers 40, 42 and 44, each of which is adapted to separate fibers from the multi-ply pulp sheets fed to them and carry the individual fibers to a foraminous forming surface, depicted as an endless foraminous flexible screen 46 which conveys the fibers downstream to the bonding section 24.

The multi-ply pulp sheets may be fed into a picker (considering as exemplary the upstream picker 38) by employing feed rolls (not shown) which positively grip the multi-ply sheet. The feed rolls comprise the sole advancing force on the plies being drawn from the rolls; and, since during operation of the picker forces acting on the multi-ply sheet during divellication may tend to advance the sheet, the feed rolls may in fact exert forces that positively restrain the advancing movement of the sheet to insure a proper rate of feed into the picker.

The pulp sheet is positively driven down a passage 48 (FIG. 2) to picker 38 which includes a rotatable cylindrical drum 50 having a plurality of picking teeth 52 positioned circumferentially and laterally along its surface. The picker teeth may suitably have a height of about ⅜ inch, a pitch of about ⅜ inch and number about 16 to 24 per square inch of circumferential surface area of the drum (e.g. — about 18 inches in diameter). Typically, the picker will be rotated at relatively high speeds, e.g. — about 1700 to 3000 r.p.m. The pulp sheet travels downwardly in the passage 48 in a direction generally circumferential to the surface of the drum 50 and is urged into contact with the picking teeth 52 by a pulp sheet feed guide 54 having a surface 56 which gradually curves to a point of approximately zero clearance relative to the tips of the picking teeth (shown at 58).

The feed guide 54 is preferably made of hard metal such as steel and has a section 60, which should desirably comprise a heat-conducting material such as aluminum to dissipate heat generated at the point of zero clearance during rotating of the drum. An insert 62 may be provided for section 60 to allow maintenance of the zero clarance at point 58 while avoiding excessive wear on the picker teeth. The material should not cause excessive wear on the picker teeth yet should be sufficiently durable to provide a reasonable operational life for the insert. In addition, the material used should be readily machineable, have a moderately high softening point (e.g. — above about 280°F.) and should not cause sparks during operation. While any material meeting the above criteria may be used, it has been found desirable to form the insert from a "Delrin" acetal resin (E. I. Du Pont de Nemours & Co., Wilmington, Delaware).

As the pulp sheet is urged towards the picker teeth, individual fibers are separated from the multi-ply sheet and are driven past the point of approximately zero clearance into a forming duct 64 designed to maintain the fibers in their separated condition and to allow transportation of the fibers to the screen in such a manner that a uniform continuum is formed. In brief, the forming duct 64 has an upstream wall 66 and a downstream wall 68 connected by side walls to form a completely enclosed duct. The duct is angularly disposed relative to the screen 46 with the downstream wall 68 diverging from the upstream wall 66 at an angle of from about 5° up to about perhaps 12° to produce a forming duct with a slightly larger cross-sectional area near the screen 46 as compared with the area adjacent the point where the fibers enter the duct. All of the internal corners of the duct are desirably curved to substantially prohibit the formation of low velocity stagnant areas in the corners that would enable fiber buildup. The buildup could produce fiber clumps which would eventually drop on to the screen and detract from the uniform appearance of the continuum.

It is desirable for the walls of the duct to be made of an electrically conductive material such as aluminum or steel so that any electrostatic field present would be substantially uniform across the interior surface of the duct. The substantial uniformity of the electric field minimizes the possibility of any isolated area with increased electrostatic potential that would exert a force on the fibers and in turn steer the fibers passing through the areas to cause nonuniform formation of the fiber continuum.

Figure 3:
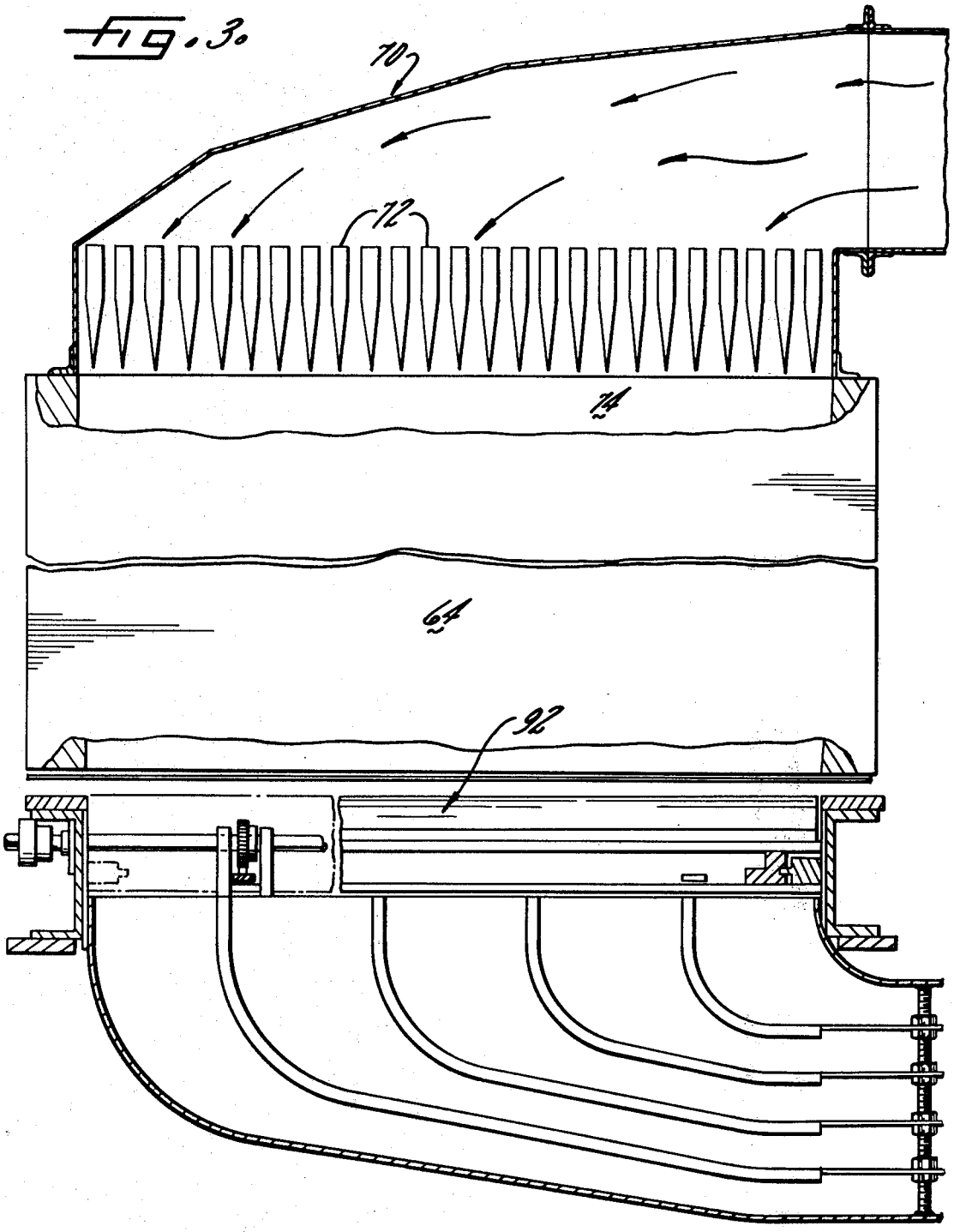
FIG. 3 is a sectional view taken generally along line 3—3 of FIG. 2, partly in cross section, and illustrating the apparatus for providing substantial uniform flow in the cross machine direction and for removing the air used in transporting the fibers to the forming surface.

An air system is employed for the picking and forming operation which provides a controlled air movement that enhances separation of the picked fibers from the picker teeth, minimizes the development of secondary flow or vortices which could result in fiber clumping, achieves substantially uniform flow across the machine direction and transports the individual fibers through the forming duct to the screen with a substantial avoidance of fiber clumping or fiber buildup on the walls of the duct. To maintain a primary air flow of substantially uniform cross direction flow with a minimum of secondary flow or vortices, as seen in FIG. 3, the air flows to the left in the primary air passage 70 with the top wall of the passage sloping downwardly across the cross direction width of the picker and downward through baffle plates 72. The tapered or constricted shape across the passage 70 should compensate for friction in the flow and should be dimensioned to provide substantially uniform flow in the cross machine direction. The baffles should be sized and spaced to first eliminate any component of flow or velocity transverse to the lengthwise dimension of the baffles and then to smoothly bring the separate flows together quickly enough to prevent significant head losses from taking place but not so rapidly that separation of flow takes place. This may be achieved, for example, by forming the baffles 72 with a uniform thickness throughout about half of their length (and preferably about three times the distance between adjacent baffle plates) and with a taper to a point with an angle not greater than about 10° relative to the direction of flow (substantially verticle as shown in FIG. 3).

The separated fibers are transported to the screen 46 forming duct with a substantial avoidance of fiber clumping by coordinating the air velocity of the primary air flow with the air volocity carrying the fibers away from the teeth (i.e. — the "process air" indicated at 73 in FIG. 2) to provide a smooth merger with minimal development of secondary flow or vortices. Thus, primary air (from a source not shown) passes through passage 74 (FIG. 2) and merges with the process air as the process air and fibers pass by the end of the feed guide as shown at 76.

Figure 2:
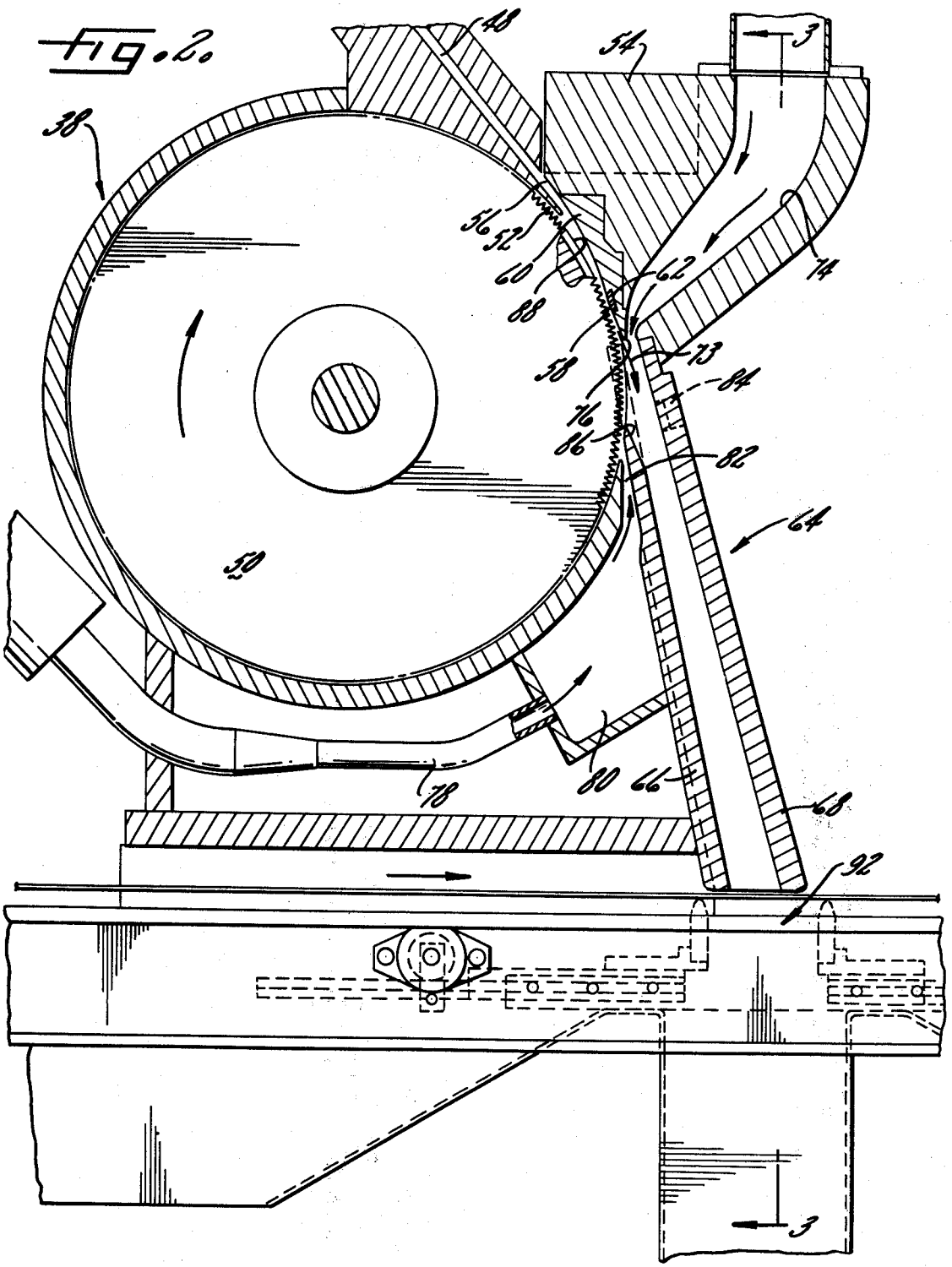
FIG. 2 is a side elevation view of a portion of the apparatus shown in FIG. 1, partly in cross section, and showing the internal construction of the apparatus at one location for picking and forming the continuum.

In addition, another air stream is provided to oppose the "process air" movement to strip or "doctor" the fibers from the picker teeth. To this end, and as seen in FIG. 2, a secondary air passage is provided with air from a source not shown. The secondary air passes through a flow evener (indicated at 80) and terminates in a cross-direction opening 82. The secondary air passing through the opening 82 should be directed to oppose the pumping action of the drum 50 and should create a sufficient pressure to effectively deflect the "process air" into the forming duct. This tends to strip or "doctor" the fibers from the picker teeth. Another important function of the secondary air is that it serves as the source for the "process air", which circulates with the rotating drum. Rotation of the drum at the levels involved herein creates a pumping action; and, in the absence of sufficient secondary air, would tend to cause recirculation of at least part of the "process air" or would suck in primary air, thereby creating undesirable flow turbulence. It has been found generally suitable to maintain a primary/secondary air ratio of about 2/1. One practical method of determining whether there is a satisfactory balance is to provide a small window 84 (covered by any suitable transparent material) in downstream wall 68. A visual determination of fiber flow can then be made, and a satisfactory balance is achieved when substantially no fibers have built up at or adjacent point 86.

The ends of the rotating drum should also be effectively sealed from the forming duct to substantially prohibit undesirable secondary air currents from entering the forming duct and disrupting the uniform flow of fibers. A flange 88 (FIG. 2) is provided at each end of the picker drum. The height of the flange is substantially equal to the height of the picker teeth and extends completely around the circumference of the drum. Referring to FIGS. 4*a* and 4*b*, a recess 90 is disposed at opposite ends adjacent the point 86 for receiving the flange 88 in close spaced relation.

Suction is used to remove the air which transports the fibers to the screen 46 to insure proper lay-down and formation. The amount of suction should desirably be controlled so that there is substantially no flow parallel to the screen 46 which would disrupt the continuum being formed. Practically, this means that the suction should be sufficient to remove all the air used to transport the fibers to the screen 46 and yet not be so excessive as to pull in any significant quantity of outside air. As shown in FIG. 2, a suction box 92 is provided adjacent the underside of the screen 46 to remove the air.

The amount of fiber which is transported to the screen 46 can be coordinated to provide the desired basis weight for the formed continuum. The particular basis weight will, of course, be determined by the requisites for the intended product applications; however, for most purposes, the basis weight will be generally in the range of from about 5 to about 50 pounds per 2880 ft.$^2$, typically between 10 and 30 pounds per 2880 ft.$^2$.

While other combinations and types of pickers, forming ducts and air systems may be employed, the use of the exemplary combination has been found advantageous and has allowed the production of uniform airlaid webs for a 14 pound per 2880 ft.$^2$ sheet at speeds up to 250 feet per minute or even more per picker with excellent formation.

In accordance with the present invention, the continuum is then wetted in such a fashion that not only is the necessary water provided for the bonding step but also that the distribution in the continuum is such that transfer into and through the bonding step, and the bonding step itself, can be effected.

The amount of water applied should be sufficient to carry out the functions as herein identified. In most situations, from about 20 to about 40% by weight of the wetted continuum will be required. Particular circumstances could require using up to about 60% by weight, but such increased amounts diminish the desirable softness. The bonding conditions and the type of bonding apparatus employed are the factors which are most important in determining the specific amount of moisture that should be used. Also, the product requisites (in terms of strength and softness) will also determine what moisture content should be employed.

In addition to using the proper amount of water, the wetting operation must provide distribution of the water in the continuum which will allow transfer into the bonding step to take place. Thus, in keeping with the present invention, the water must partially penetrate into the continuum to provide free water (i.e. — unabsorbed by the fibers) therein so that some coherency will be imparted and transfer can be effected without damage to the flimsy continuum. Also, sufficient free water must remain on the surface of the continuum so that the wetted surface will adhere to the transfer surface in preference to remaining on the wire on which it was formed. In this connection, the wetting of the continuum should provide a differential water gradient through the continuum thicknss so that the screen side of the continuum is relatively dry in comparison to the wetted side. This is believed to enhance stripping from the screen while minimizing the amount of fibers left on the screen following transfer therefrom.

Turning again to the drawings, and as seen in FIG. 5, these objectives are achieved by providing a moisturizing station having a number of spray nozzle 94 secured to a transverse bar 96 above the surface of the continuum being carried by the screen 46. The height of the nozzles above the continuum and the cross-direction spacing should be such that the nozzle spray patterns partially overlap to achieve a substantially uniform cross-directional water application. The droplet size is not thought to be particularly critical and may, typically, be in the range of perhaps about 10 to about 100 microns. A suction box 98 is provided underneath the screen 46 to enhance penetration of the sprayed water into the continuum and minimize the amount of water which deflects off the continuum surface (commonly termed "overspray"). Generally, a suction of from about 2 to 10 inches water will be sufficient. In keeping with the present invention, the suction is desirably maintained at a level which is sufficient to prevent any significant overspray. At this level, the moisture distribution in the continuum is suitable for the transfer operation. The substantial absence of overspray can be determined by visually viewing the continuum. The machine direction dimension of the suction box should be carefully coordinated with the nozzle spray patterns since an insufficient length will result in overspray while too long a dimension or length will tend to undesirably dry out the continuum. Typically, the lengthwise dimension may vary from about 8 to 24 inches.

Because the edges of the continuum may typically be ragged or fuzzy and often of different basis weights from the rest of the continuum, it is desirable to employ a pair of baffle plates 100 to effectively limit application of water to these edges. This allows easy separation of these edges by trimming with a pair of air jets 102 (FIG. 6), positioned to cleanly cut the edges. The unusable edges may perhaps amount to about ½ to 1 inch from each side.

Following trimming, it is desirable to provide a method of automatically stripping the continuum from the screen 46 until equilibrium operation is achieved so that the continuum is not subjected to further prosecution until the desired conditions are reached. To achieve this result, a continuum pickup assembly is provided (FIGS. 6 and 7) which includes a fan connected to a duct not shown and a movable exhaust duct 108 which is divided into two ducts 110, each having a canopy 112 terminating in a slot 114 extending along the entire width of the continuum. The fan provides a vacuum in the slot 114 of sufficient magnitude to pick up the complete continuum during startup or threading which is normally conducted at speeds of about 100 feet per minute or less. To assist in the pickup, an air knife 116 positioned below the screen 46 may be employed. Desirably, the assembly is movable transversely across the screen 46 so that progressively less of the continuum is exposed to the vacuum, and the increasing unexposed portion remains on the screen 46 and is allowed to transfer to the bonding section in accordance with the present invention. This allows initiation of the transfer operation with less than the entire width of the continuum, perhaps only a few inches as opposed to a full width of 46 inches or even more. The duct 108, the ducts 110 and the canopies 112 may accordingly form a unitary structure suspended on slide brackets 118 movable on support rod 120. A chain or the like is carried by two sprockets 124 and 126, with the sprocket 124 having a handle 128. The chain is connected to one of the canopies 112 as shown at 130 and rotation of the handle 128 moves the continuum pickup assembly to the left as shown in the dash lines of FIG. 7.

The flimsy, wetted, unbonded fiber continuum, in accordance with an important aspect of the present invention, is then transferred from the forming screen 46 into and through a bonding step in which the continuum is transformed into a coherent web. To this end, stripping is effected by adhering the wetted surface of the continuum to a moving transfer surface diverging from the screen 46 in such a fashion that the web is not adversely effected. It is believed that adherence to the transfer surface is due to capillary attraction forces. Also, it is hypothesized that typical air laying operations charge the fibers, and an airlaid web is thus electrostatically held on to a metallic screen. The water spray thus also serves to dissipate this charge.

More particularly, separation from the screen 46 is effected by passing the continuum, depicted by a dashed line W, FIG. 8, across a "limited gap" (designated X in FIG. 8) to a transfer surface, herein shown as provided by a roll 134, so as to adhere the wetted surface thereto. The transfer surface is moved away from the screen 46 at a surface speed faster than the screen speed to create a draw. The extent of the draw is that which is necessary to prevent the tendency of the continuum to follow the screen 46. Increasing gaps require increased draws. By the term "limited gap" is meant a clearance X between the screen 46 and the transfer surface provided by the roll 134, which is sufficiently limited that a draw between the transfer surface and the screen 46 can compensate for the tendency of the continuum to follow the screen 46 without significant disruption of the continuum or process uncontrollability. Stated another way, limited gap transfer in accordance with the present invention requires the continuum to be in a substantially tangential relationship to the screen 46 and the transfer surface provided by the roll 134 across the gap X. If the gap X is too great, this relationship cannot be maintained at high speeds, regardless of the extent of draw. Clearances greater than about ½ inch, certainly 1 inch, are believed to be unacceptable.

In accordance with a more detailed aspect of the present invention, and to achieve all the advantages thereof, transfer is effected by providing a gap X between the screen 46 on which the wetted continuum is traveling and the transfer surface provided by the roll 134 such that, at the closest point the continuum is in contact with both the screen 46 and the transfer surface provided by the roll 134 (i.e. — the gap X is no greater than the uncompressed thickness of the continuum). The gap X should not be so small in comparison to the continuum thickness that substantial compressing will take place since this would detrimentally affect the bulk and softness of the resulting web; however, under conditions of this method of transfer, termed the "rolling mode", it is desirable to have a gap X sufficiently less than the continuum thickness so that the continuum is partially compressed during transfer and its integrity increased to minimize the possibility of damage to the continuum during transfer. For a web having a final basis weight of about 14 pounds per 2880 ft.$^2$, the gap X between the screen 46 and the transfer surface provided by the roll at the point of transfer will generally be in the range of from about 0.005 inches to about 0.020 inches. In this mode, the draw required is generally about 5%.

In accordance with another aspect of the present invention, transfer may be affected by a mode, termed the "stretch mode". In this embodiment, the clearance or gap X between the screen 46 and the transfer surface provided by the roll 134 at the point of transfer is such that there is no simultaneous contact of the continuum with both the screen 46 and the transfer surface. Because of this lack of contact, the continuum is literally pulled off the screen 46 by tension forces created by the transfer surface. The draw required in this mode increases with increasing gaps. For example, a 12% or slightly greater draw is necessary with a 14 lb./2880 ft.$^2$ continuum when the gap X is about ⅛ inch.

It should be appreciated that, while startup may be automatic, particularly in the rolling mode, some assistance may be required to initially remove the leading edge of the continuum from the screen 46 and to cause adherence to the transfer surface. This assistance may be provided (either manually or automatically) by an appropriately directed air gun.

Referring to FIG. 8, the screen 46 carrying the fiber continuum is passed around a horizontally adjustable screen support roll 132 shown as a suction roll. A transfer roll 134 is positioned downstream and adjacent to roll 132 and presents a moving transfer surface diverging away from the screen 46. The transfer roll 134 may be made of a hard material such as steel or a softer material having some resilience, such as for example, nylon. The specific requirements for the transfer roll will be further amplified in connection with the discussion of the bonding step. While the transfer operation serves to remove substantially all the fibers from the screen 46, it should be understood that it may be desirable to clean the screen 46 following transfer to remove any fiber residue. This may be accomplished by using a brush and an air knife arrangement as is known.

Having now been stripped from the forming screen 46, the wetted fiber continuum is hydrogen bonded in accordance with the present invention by selectively applying sufficient pressure and heat in predetermined areas to form a coherent web. To achieve proper hydrogen bonding, sufficient pressure and heat should be employed so that the fibers in the nip Y are completely bonded. These parameters must be coordinated so that the desired strength requirements are achieved and the resulting web has the desired coherency. In other words, as has been herein discussed, the depthwise distribution of the water in the continuum is irregular, i.e. — the relative wetness or amount of water decreases from the sprayed side to the screen side. Indeed, under some applications, the screen side will be relatively dry; and, if insufficient pressure and heat are applied, the resulting web will not have sufficient coherency and the dryer side may be separated from the wetter side.

Accordingly, the pressure applied is desirably achieved by combining a transfer roll 134 with a smooth surface which serves as an anvil roll and a bonding roll 136 having raised surfaces at a frequency of from about 10 to about 40 per inch in either direction and the raised surfaces sized to provide a total web bond area of from about 10 to about 40 per cent. The frequency should also be such that the bonded areas are less than the average fiber length apart, and the frequencies set forth are satisfactory to accomplish the desired spacing. While the transfer and anvil roll does not have to be as hard as soft steel, the Young's Modulus and Poisson's ratio must be such that point pressures in the necessary range may be developed. Thus, materials with a Young's Modulus and Poisson's ratio indicating that they are significantly softer than nylon would be unsatisfactory. Such materials would tend to flatten out in the nip areas and decrease the amount of pressure that can be developed below that which is necessary and would tend to cause a patterning effect on the web. On the other hand, when smooth metallic materials are used for the transfer and anvil roll, the hardness must be less than the hardness of the bonding roll to avoid fracturing the points of the bonding roll.

As illustrated in FIG. 9 bonding roll 36 has its axis journaled in vertically adjustable bearing blocks 138, located at opposite ends thereof and vertically controlled by a pair of hydraulic cylinders 140 that are, in turn, controlled by conventional apparatus, not shown. Elongation of the cylinders can be adjusted to provide the desired pressure in the nip formed between the bonding roll 136 and the transfer roller 134, typically measured in pounds per lineal inch. The bonding roll 136 should be provided with a means of internal heating, as by holes that allow the roll surface to be heated by any conventional heating medium such as oil or the like.

FIG. 10 shows a desirable pattern for the rasied surfaces of the bonding roll 136. Raised surfaces 144 have a generally circular shape and are arranged in adjacent rows, each of which may be centered at an angle $\alpha$ and within the range of about 0.5° to 3° relative to a line on the roll circumference parallel to its axis. The circular surfaces within each of the rows are slightly overlapping with surfaces in adjacent rows so that a line 146 will intersect surfaces 144 in adjacent rows. Canting reduces wear on the raised surfaces and minimizes unit pressure variations in the nip and is thus particularly desirable where a steel transfer roll is used.

Circular shapes provide maximum strength for a given bond area and may minimize wear on the points. However, other geometric shapes such as diamonds and the like may also be used. The raised points should have a smooth surface and the height of the points and the slopes from the roll surface should be coordinated with the pressure conditions involved to minimize compaction of the continuum between raised areas but should allow use without undue breakage of the points.

The pressure which the points exert on the fibers must, of course, be coordinated with the other process parameters to provide the desired bonding results. Also, as has been pointed out, the type of transfer and anvil roll 134 used will determine the practical limits of operation. With a nylon roll, it is desirable to use a point pressure of at least 5,000 p.s.i. while soft steel allows development of up to about 50,000 p.s.i. or so. Use of higher pressures with a nylon transfer and anvil roll may make it desirable to employ a smoothing roll 148 (FIG. 8) to remove possible dimpling or pebbling of the roll 134 so that a smooth surface is presented at the bonding nip Y.

In accordance with yet another aspect of the present invention, the bonding roll 136 is heated by any conventional means, such as internal heating as has been herein described, to prevent adherence of the continuum to the roll and also to combine with the moisture and pressure to achieve the desired bonding. With nylon as a transfer and anvil roll 134, and at speeds above about 100 or 200 feet per minute, a bonding roll 136 surface temperature of about 150°F. may be adequate to achieve release of the web from the roll. However, it may be desirable to employ higher temperatures to enhance the effect of the heat on the bonding. When a steel transfer and anvil roll 134 is used, the bonding roll 136 may be heated to a temperature above the boiling point of water, typically above about 220°F. Higher temperatures may, of course, be employed but are unnecessary to achieve the desired bonding.

It should thus be appreciated that the heating of the bonding roll 136 is utilized for two purposes which are essentially independent. The minimum temperature necessary is the point at which bonding can be carried out without the web sticking to the bonding roll 136. Heating the roll 136 to temperatures above the minimum necessary to achieve the desired bonding will be dependent upon the speed, the basis weight of the web involved, and the type of transfer and anvil roll.

In accordance with another aspect of the present invention, when the transfer roll 134 is steel, the roll must be heated to a temperature sufficient to allow release of the web therefrom after bonding has taken place. To this end, a steel transfer roll is heated to a temperature that will allow the bonded web to release from the transfer roll 134 yet which allows transfer from the screen to the transfer roll to take place in the first instance. Typically, this will require a surface temperature above 140°F. and desirably in the range from about 180°F. up to about 250°F. The temperature is measured at a point on the surface of the roll, as indicated at 149 in FIG. 8.

Separation of the bonded web may then be effected and the web subjected to drying to reduce the moisture content to the level of about 8% or less. As shown in FIG. 8, the web is separated from the transfer roll 134 by a suction roll 150 on to a screen 152 which carries the wetted, bonded web through a drying operation, such as through dryer, schematically illustrated at 154 (FIG. 1).

In addition to the embodiment for carrying out the transfer and bonding steps which has been herein described, varying conditions may make applicable other embodiments. Thus, in some situations, it may be desirable to achieve transfer by positioning the elements so that there is no support provided for the screen at the point of transfer, and an "open screen" transfer can be achieved. As seen in FIG. 11, the continuum W (depicted by a dashed line) riding on screen 46 is passed around a pair of screen support rollers 156, 156', which are vertically spaced to allow transfer therebetween. Transfer is effected as indicated at point 158 from the screen 46 to transfer roll 160. The bonding is carried out, as before, by passing the continuum through the nip Y between transfer roll 160 and bonding roll 162 and is then removed by suction roll 164 and collected on screen 166 for further processing as has been herein described. Generally, acceptable transfer in this embodiment is effected only when the screen 46 is partially wrapped around the transfer roll 160. The wrap provides good contact of the continuum with the transfer roll and should generally be in the range of from about 0.5 to about 2 inches.

In accordance with another aspect of the present invention, spraying of the continuum on both of its surfaces may be effected. The application of water to both sides of the continuum achieves more uniformity of the distribution of the water throughout the thickness of the continuum so as to make the bonding operation easier and to substantially reduce the possibility that the formed web will have one surface with insufficient coherency as could occur when only one side of the continuum is moisturized. As shown in FIG. 12, an inverted section is employed to separate the wetted continuum (depicted by a dashed line) from its carrier following the first spray application and to hold the wetted continuum while exposing its dry surface to a second spraying operation. The twice-sprayed continuum then passes into the nip for the bonding operation. It is particularly desirable to employ this inverted section embodiment wherein the transfer roll has a resilient surface; in such situations, the double application of moisture compensates for the inability to develop the high unit pressures on the bonding roll raised surfaces which can be achieved with a soft steel transfer roll.

Considering this embodiment in greater detail, the inverted section includes a second foraminous screen 168 which partially overlies the first screen 46 and is adapted to retain the fiber continuum from above and convey it into the bonding operation. A suction box 170 is provided to remove the continuum from screen 46 and hold it against gravity on the screen 168. Section 172 of the duct 170 is sized to accommodate the spray pattern from the moisturizing station, schematically indicated at 174, that is positioned downstream of screen 46 and below the screen 168. The suction used in section 172 should be sufficient to allow penetration of the moisture into the web as well as to hold the web against the screen. For a 14 lb. per 2880 ft.$^2$ web, the suction will be typically between about 2 to 10 inches of water while the remainder of the suction may be about ½ inch water or perhaps more.

Transfer is effected in a substantially similar fashion as before, except that since the operation is inverted, the continuum is traveling upwardly when transfer takes place rather than generally downwardly as in the embodiment illustrated in FIG. 8. As is thus shown, the continuum passes upwardly into a nip and across a limited gap X between a tail roll 176 for the screen 168 and a transfer roll 178. The surface of screen 168 must have characteristics such that the wetted surface of the continuum will transfer to the transfer roll in preference to remaining on the screen. It has been found preferable to employ a screen having a "Teflon" polytetrafluoroethylene resin coating (E. I. Du Pont de Nemours & Co., Wilmington, Delaware) on a screen made of, for example, bronze. The transferred continuum is then passed into the bonding nip formed between transfer roll 178 and a bonding roll 180 having the desired patterned configuration. To remove the bonded web from the surface of the transfer roll, a screen 182 with a support roll 184 and an intermediate roll 186 with a suction segment 188 are provided.

Thus, the present invention provides a method of forming an airlaid, spotbonded web that may be advantageously employed for tissue and toweling applications. By employing the limited gap transfer technique of this invention, an unbonded, airlaid continuum can be stripped from the screen on which it is formed by adhering to a transfer surface and thereafter bonding to transform the continuum into a coherent web while still on the transfer surface at speeds in excess of 1,000 feet per minute.

We claim:

1. A high speed method for production of a continuous airlaid web of wood pulp fibers of a basis weight in the range of about 5–50 lbs. per 2880 ft.$^2$ and having a three-dimensional continuum interrupted by a pattern of compacted hydrogen bonded areas, wherein a continuum of such fibers is transferrable from an airlaying screen to a moving transfer surface at transfer surface speeds in execess of 1000 feet per minute, which method comprises:

a. air laying wood pulp fibers on a moving screen to form a three-dimensional continuum within said range of basis weight;

b. applying sufficient water to the outer surface of the continuum which is away from the screen such that between about twenty per cent to about sixty per cent by weight of the wetted continuum is water, free water remains on said outer surface of the continuum and the relative amount of water in the continuum decreases from said outer surface of the continuum to the other surface adjacent the screen so that said other surface is relatively dry in comparison to said outer surface, c. removing the wetted continuum from the screen by contacting said outer surface of the continuum with a rotating transfer roll presenting a moving transfer surface moving at a surface speed faster than the speed of the screen and separated from the screen by a gap no greater than about ½ inch at the closest point and thereafter diverging from the screen, said wetted continuum having sufficient free water therein from step (b) so that coherency is imparted, and on said outer surface so that the outer surface adheres to the transfer surface and the relatively dry other surface strips from the screen and the rotating transfer roll draws the continuum across the gap and away from the screen, and d. bonding the continuum by maintaining the wetted continuum in contact with the surface of the rotating transfer roll and passing the wetted continuum through a nip formed between the rotating transfer roll and a heated rotating bonding roll having a patterned surface, with said bonding roll being held against the transfer roll to provide a temperature and pressure in spaced areas determined by the surface pattern sufficient to compress and hydrogen bond fibers in such areas and provide a self-sustaining web consisting of a three-dimensional continuum of substantially unbonded fibers interrupted by hydrogen bonded areas.

2. The method of claim 1 wherein the minimum thickness of said gap is less than the thickness of the uncompressed continuum such that the continuum is partially compressed during transfer to increase its coherency.

3. The method of claim 1 wherein the continuum is wetted in step (b) to provide a water content of from about 20 to about 40% by weight of the moisturized continuum.

4. The method of claim 3 including applying suction from below the screen to the continuum during wetting in step (b) so as to assist penetration of the water interiorly of the continuum.

5. The method of claim 4 wherein the suction applied is in the range of from about 2 to about 10 inches of water and the suction is applied over an area generally coincident with the wetted portion of the continuum.

6. The method of claim 1 wherein the bonding roll is heated to a temperature of at least about 150°F. so that the temperature is sufficient in combination with the moisture in the continuum under the pressure condition in the nip to hydrogen bond the fibers in the areas of the pattern, and to provide a sufficiently high temperature so that the bonded web separates from the bonding roll.

7. The method of claim 6 wherein the transfer surface is nylon.

8. The method of claim 7 wherein the bonded web is removed from the transfer surface after the nip by suction and is retained on a second screen.

9. The method of claim 8 which includes drying the web on the second screen to reduce the moisture content to below about 8% by weight of the bonded web.

10. The method of claim 9 wherein the drying is carried out by passing heated air through the web.

11. The method of claim 7 which includes contacting the nylon transfer surface with a smoothing surface for the purpose of removing indentations from the transfer surface caused by the patterned surface of the bonding roll for presenting a smooth surface at the nip.

12. The method of claim 6 wherein the transfer surface is provided by a steel roll, and the transfer roll is heated to a temperature sufficient that the bonded web separates from the transfer roll.

13. The method of claim 12 wherein both the bonding and transfer rolls are steel rolls, and the bonding roll is heated to a temperature of at least about 220°F.

14. The method of claim 6 wherein the transfer roll is steel and heated to a temperature in the range from about 180°F. to about 250°F., such that the unbonded continuum transfers from the screen to the transfer roll and the bonded web transfers from the transfer roll.

15. The method of claim 1 which includes removing the bonded web from the transfer surface following the nip by suction and transferring the web to a second moving screen.

16. The method of claim 15 which includes drying the wetted, bonded web on the second screen.

17. The method of claim 16 wherein the drying is carried out by passing heated air through the web.

18. A high speed method for production of a continuous airlaid web of wood pulp fibers of a basis weight in the range of about 5–50 lbs. per 2880 ft.$^2$ and having a three-dimensional continuum interrupted by a pattern of hydrogen-bonded areas, wherein a continuum of such fibers is transferable from a moving screen to a moving transfer surface at transfer surface speeds in excess of 1000 feet per minute, which method comprises:

a. air laying wood pulp fibers on a first moving screen to form a three-dimensional continuum within said range of basis weight;

b. spraying water onto the surface of the continuum which is away from said first screen to wet said surface of the continuum, c. contacting the wetted surface of the continuum with a second moving screen and transferring the continuum from the first screen to the second screen, d. spraying sufficient water onto the outer surface of the continuum which is away from said second screen such that together with the water in the continuum from step (b) between about twenty per cent to about sixty per cent by weight of the wetted continuum is water, and free water remains on said outer surface of the continuum;

e. removing the wetted continuum from the second screen by contacting said outer surface of the continuum with a rotating transfer roll presenting a moving transfer surface moving at a surface speed faster than the speed of the second screen and separated from the second screen by a gap no greater than about ½ inch at the closest point and thereafter diverging from the second screen, said continuum having sufficient free water therein from steps (b) and (d) so that coherency is imparted and on said outer surface so that the outer surface adheres to the transfer surface, the second screen having a surface with a release characteristic such that the continuum strips from the second screen and the rotating transfer roll draws the continuum across the gap and away from the second screen; and f. bonding the continuum by maintaining the wetted continuum in contact with the surface of the rotating transfer roll and passing the wetted continuum through a nip formed between the rotating transfer roll and a heated rotating bonding roll having a patterned surface, with said bonding roll being held against the transfer roll to provide a temperature and pressure in spaced areas determined by the surface pattern sufficient to compress and hydrogen bond fibers in such areas and provide a self-sustaining web consisting of a three-dimensional continuum of substantially unbonded fibers interrupted by hydrogen-bonded areas.

19. The method of claim 18 wherein the second screen surface is of a polytetrafluoroethylene resin material.

20. A method according to claim 1 wherein the screen is generally vertical and downwardly moving when the wetted continuum is removed in step (c) and the rotating transfer roll is positioned so that the screen is at least partially deflected by said transfer roll.

21. In a high speed method for production of a continuous airlaid web of wood pulp fibers of a basis weight in the range of about 5–50 lbs.. per 2880 ft.$^2$ and having a three-dimensional continuum interrupted by a pattern of compacted hydrogen bonded areas, from an unbonded airlaid three dimensional continuum of said wood pulp fibers within said range of basis weight and supported on a moving screen, the improvement whereby said unbonded continuum is transferrable from said moving screen to a moving transfer surface at transfer surface speeds in excess of 1000 feet per minute, which improvement comprises:

a. wetting the continuum with water such that between about twenty per cent to about sixty per cent by weight of the wetted continuum is water, and free water remains on the outer surface of the continuum which is away from the screen;

b. removing the wetted continuum from the screen by contacting said outer surface of the continuum with a rotating transfer roll presenting a moving transfer surface moving at a surface speed faster than the speed of the screen and separated from the screen by a gap no greater than about ½ inch at the closest point and thereafter diverging from the screen, said wetted continuum having sufficient free water therein from step (a) so that coherency is imparted, and on said outer surface so that the outer surface adheres to the transfer surface, the characteristics of the screen surface and the other surface of the continuum being such that the continuum strips from the screen and the rotating transfer roll draws the continuum across the gap and away from the screen; and c. bonding the continuum by maintaining the wetted continuum in contact with the surface of the rotating transfer roll and passing the wetted continuum through a nip formed between the rotating transfer roll and a heated rotating bonding roll having a patterned surface, with said bonding roll being held against the transfer roll to provide a temperature and pressure in spaced areas determined by the surface pattern sufficient to compress and hydrogen bond fibers in such areas and provide a self-sustaining web consisting of a three-dimensional continuum of substantially unbonded fibers interrupted by hydrogen-bonded areas.

* * * * *